US006726301B2

(12) United States Patent
Walker

(10) Patent No.: US 6,726,301 B2
(45) Date of Patent: Apr. 27, 2004

(54) DROP VOLUME COMPENSATION AT LEAST SUBSTANTIALLY REFLECTANCE SENSOR ILLUMINATE INVARIANT

(75) Inventor: Steven H. Walker, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

(21) Appl. No.: 10/176,813

(22) Filed: Jun. 20, 2002

(65) Prior Publication Data

US 2003/0234828 A1 Dec. 25, 2003

(51) Int. Cl.[7] ..... B41J 2/205; B41J 2/21
(52) U.S. Cl. ..... 347/15; 347/43
(58) Field of Search ..... 347/15, 43, 19, 347/37

(56) References Cited

U.S. PATENT DOCUMENTS 5,997,124 A 12/1999 Capps et al. ..... 347/14
6,030,066 A * 2/2000 Li et al. ..... 347/19
6,154,227 A 11/2000 Lund ..... 347/14
6,270,178 B1 * 8/2001 Wada et al. ..... 347/7
6,431,679 B1 * 8/2002 Li et al. ..... 347/19

FOREIGN PATENT DOCUMENTS

EP 0 963 844 12/1999 ..... B41J/2/045

* cited by examiner

*Primary Examiner*—Thinh Nguyen

(57) ABSTRACT

Drop volume compensation that is at least substantially invariant to the reflectance sensor illuminate being used is disclosed for at least some embodiments of the invention. A method of one embodiment first prints a pattern of a predetermined mixture of colorants that results in at least a substantially identical response from each of a number of reflectance sensors that have different spectral emission profiles. Drop volume compensation is then performed to color balance a first colorant source to a second colorant source, utilizing the mixture of colorants and one of the reflectance sensors. The drop volume compensation is at least substantially invariant to the reflectance sensor utilized.

34 Claims, 8 Drawing Sheets

DROP VOLUME COMPENSATION AT LEAST SUBSTANTIALLY REFLECTANCE SENSOR ILLUMINATE INVARIANT

BACKGROUND OF THE INVENTION

Color inkjet printers have become popular for printing on media when precise printing of color images is needed. For instance, such printers have become popular for printing color image files generated using digital cameras. Within such printers, accurate color printing can be ensured by using two inkjet print cartridges, each having corresponding color inks. One print cartridge, for instance, may have the colors cyan, magenta, and yellow, whereas the other print cartridge may have the colors light cyan, light magenta, and light yellow.

For accurate color printing, the two inkjet print cartridges should be color balanced with one another. Manufacturing, process, and formulation variations can alter the nominal drop volumes of the print cartridges, upsetting the balance between the two print cartridges, and thus causing the reproduced colors to shift in hue. Drop volume compensation is one process used to color balance the two print cartridges. Drop volume compensation determines the change in saturation level needed for the colors of one of the print cartridges to match the corresponding colors of the other print cartridge. Accurate color printing can then be accomplished more easily. The saturation levels themselves are dependent on the relative drop volumes of ink ejected from the print cartridges, hence the phrase drop volume compensation.

A reflectance sensor measures the optical density of a pattern printed with ink of unknown drop volume at a specific saturation level from an inkjet print cartridge. Within the same type of printer, different kinds of reflectance sensors from different manufacturers may be used. These different reflectance sensors may measure saturation levels differently, affecting the drop volume compensation, and hence the color balancing of the inkjet print cartridges. For this and other reasons, therefore, there is a need for the present invention.

SUMMARY OF THE INVENTION

At least some embodiments of the invention disclose drop volume compensation that is at least substantially invariant to the illuminate of the reflectance sensor being used. A method of one embodiment first prints a pattern of a predetermined mixture of colorants that results in at least a substantially identical response from each of a number of reflectance sensors that have different illuminate spectral emission profiles. Drop volume compensation is then performed to color balance a first colorant source to a second colorant source, utilizing the predetermined mixture of colorants and one of the reflectance sensors. The drop volume compensation is at least substantially invariant to the reflectance sensor utilized.

BRIEF DESCRIPTION OF THE DRAWINGS

The drawings referenced herein form a part of the specification. Features shown in the drawings are meant as illustrative of only some embodiments of the invention, and not of all embodiments of the invention, unless otherwise explicitly indicated, and implications to the contrary are otherwise not to be made.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. For example, whereas the invention is partially described in relation to an inkjet printer dispensing ink, it is more broadly applicable of any colorant ejection system ejecting colorant, and, more broadly still, any image-forming device. The following detailed description is therefore not to be taken in a limiting sense, and the scope of the present invention is defined only by the appended claims.

Overview

Figure 1:
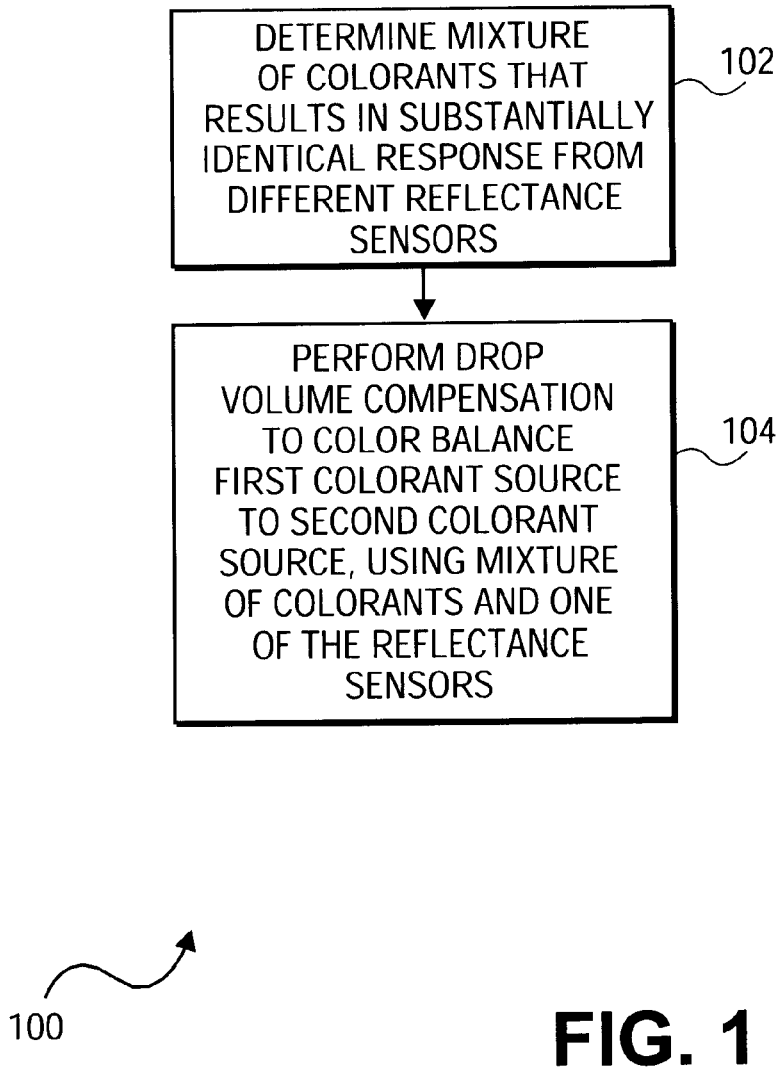
FIG. 1 is a flowchart of a method, according to an embodiment of the invention.

FIG. 1 shows a method 100 according to an embodiment of the invention. Parts of the method 100, as well as parts of methods of other embodiments of the invention, can be implemented as computer programs stored on computer-readable media. Such computer-readable media may include semiconductor-based memories, such as firmware, that include read-only memories (ROM's), random-access memories (RAM's), and so on, as well as may include optical discs, floppy disks, and other types of media. Such computer programs may also have different means that perform the functionality of corresponding parts of the methods that the computer programs implement. Such means may include and correspond to different components, modules, objects, sub-routines, and so on, of the computer program.

The method 100 first determines a mixture of colorants that result in at least a substantially identical response from each of a number of reflectance sensors that have different spectral emission profiles (102). The term colorant generally encompasses color inkjet ink. Generally, the colorants include cyan colorant, yellow colorant, and magenta colorant; in some embodiments, a range of intensities, such as lighter and darker shades, of a particular color colorant may also be included. The colorants may also include black colorant. The reflectance sensors may include light-emitting diodes (LED's), such as blue LED's, or fluorescing, or incandescent, emitters, or another type of illuminate that is used to output light. The spectral emission from the sensor may be modified by using opaque or transmissive filters.

A reflectance sensor's illuminate thus outputs light that is reflected by a given pattern and detected. The response of a reflectance sensor thus corresponds to the amount of light detected by the sensor as reflected back from the pattern. The amount of light that reflects back from the pattern is dependent on the pattern itself. Different patterns may have different colorants and different mixtures of colorants, which reflect back different amounts of light. Furthermore, different reflectance sensors may detect different amounts of light reflecting back from the same mixture of colorants. This latter difference results from the reflectance sensors having different spectral emission profiles.

Figure 2:
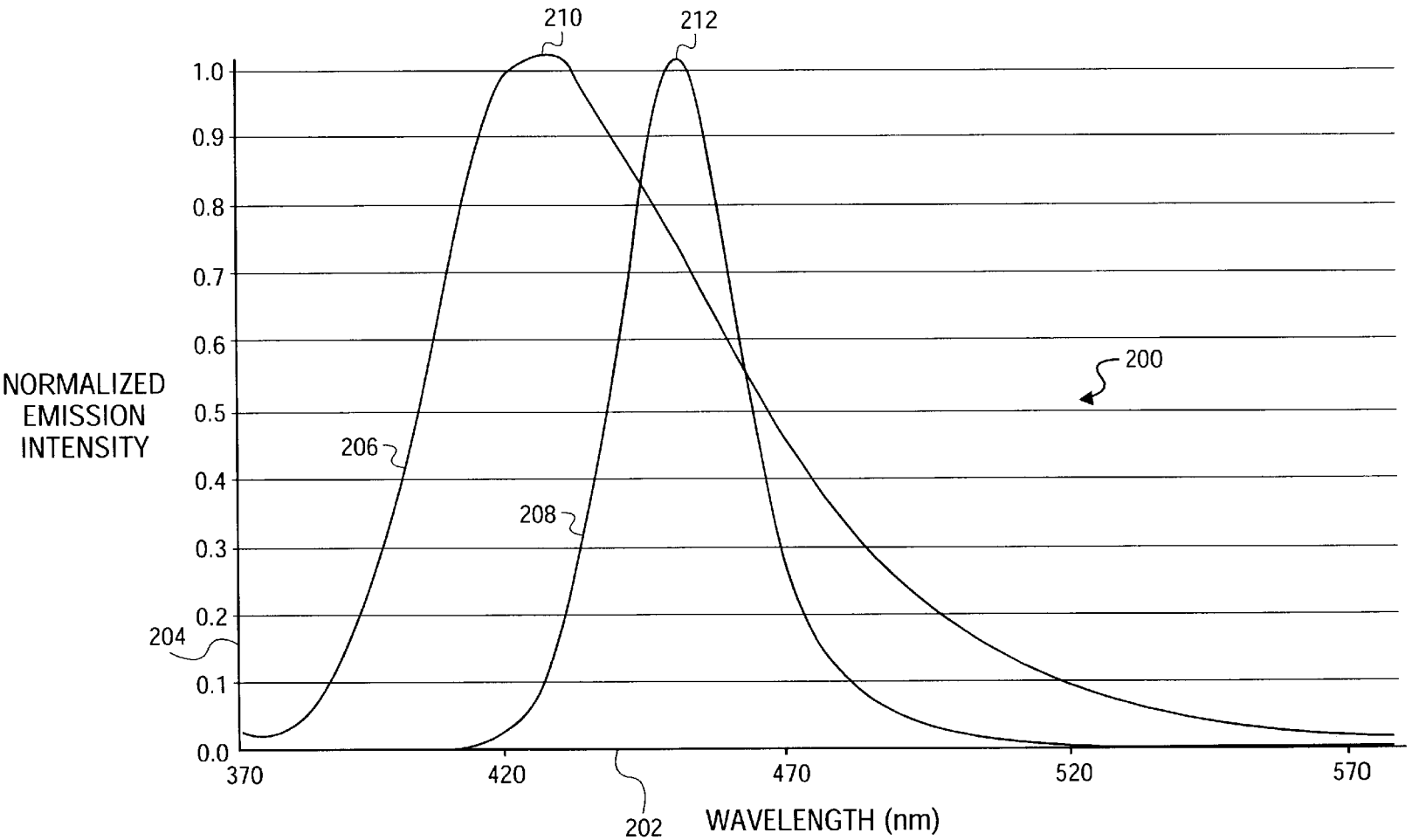
FIG. 2 is a graph showing as an example the spectral emission profiles of two different illuminates from reflectance sensors that can be utilized in an embodiment of the invention.

A spectral emission profile of a reflectance sensor encompasses the spectral emission of the light output by the reflectance sensor. The spectral emission profile of a reflectance sensor, for example, typically encompasses the shape of the spectral emission of the light output by the sensor, the peak wavelength of this spectral emission, and so on. FIG. 2 shows a graph 200 illustrating the spectral emission profiles 206 and 208 of two reflectance sensors having different illuminates. The x-axis 202 indicates the wavelength of light, in nanometers (nm), whereas the y-axis 204 indicates the spectral emission intensity of the light within a normalized scale of 0.0 to 1.0.

The spectral emission profiles 206 and 208 vary in a number of different ways. The peak wavelength 210 of the profile 206 is less than the peak wavelength 212 of the profile 208. Furthermore, as can be seen from FIG. 2, the profile 206 is asymmetrical, whereas the profile 208 is substantially symmetrical. The spectral emission profile 206 also occurs over a wider range of wavelengths than does the spectral emission profile 208. As a result of these different spectral emission profiles 206 and 208, the reflectance sensors to which they correspond will likely detect different amounts of light reflected back from a given pattern.

Therefore, referring back to FIG. 1, block 102 of the method 100 determines a mixture of colorants that results in the reflectance sensors detecting the same amount of light reflected back therefrom. That is, the mixture of colorants that results in substantially the same response from each reflectance sensor is determined. Such a mixture of colorants allows for analysis to be performed relative to a pattern that includes this mixture of colorants and is independent of the reflectance sensor that is used for the analysis.

Next, the method 100 performs drop volume compensation to color balance a first colorant source to a second colorant source, utilizing the mixture of colorants and one of the reflectance sensors (104). The drop volume compensation is at least substantially invariant to the reflectance sensor utilized, because the mixture of colorants results in substantially the same response from each of the reflectance sensors. The term colorant source encompasses inkjet print cartridges capable of outputting the colorants.

For instance, the first colorant source may output light-dye versions of cyan colorant, magenta colorant, and yellow colorant, which are referred to as light cyan colorant, light magenta colorant, and light yellow colorant. The second colorant source may output standard-dye (i.e. darker) versions of the cyan, magenta, and yellow colorants. The drop volume compensation determines the saturation at which the light-dye versions of the colorants match the standard-dye versions of the colorants, to take into account variations between the two colorant sources. Typically, a greater amount of the light-dye version can match a lesser amount of the standard-dye version.

Figure 3:
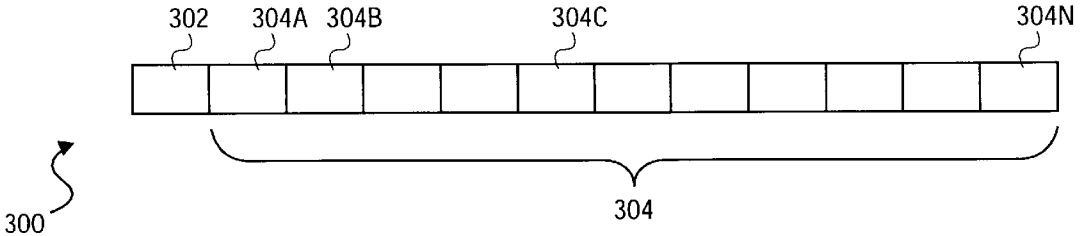
FIG. 3 is a diagram of an example of a drop volume compensation pattern that can be utilized in an embodiment of the invention.
Figure 4:
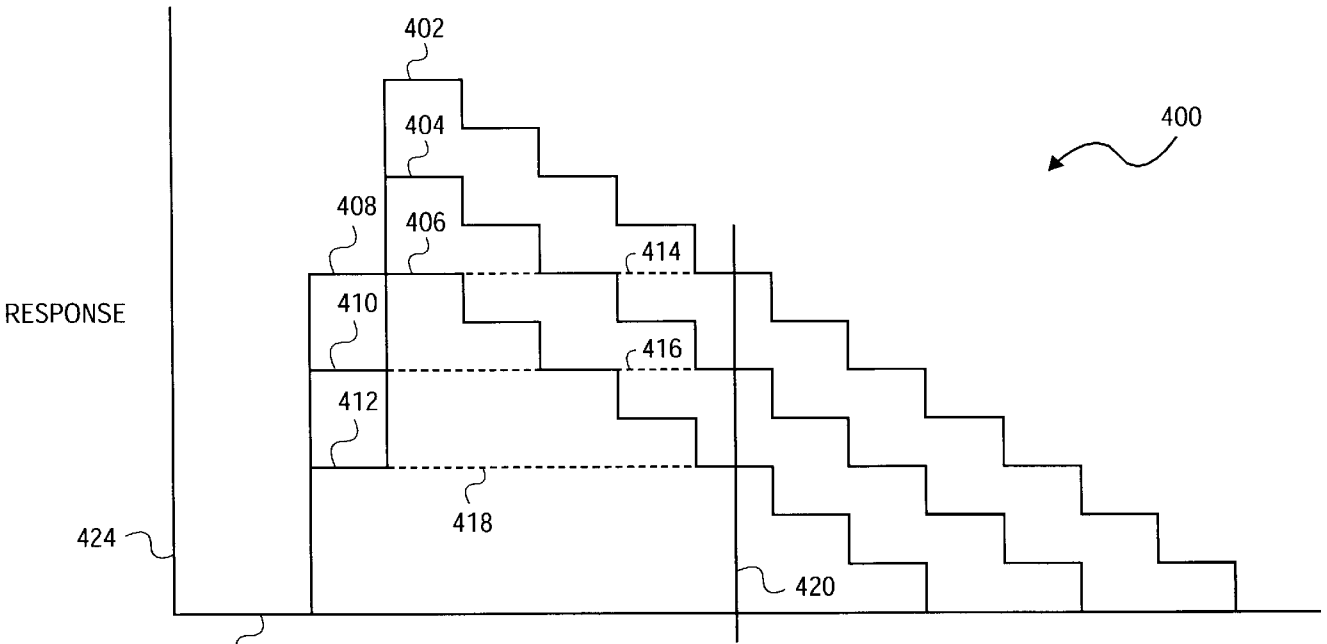
FIG. 4 is a graph showing the responses of three different reflectance sensors to the drop volume compensation pattern of FIG. 3, in an embodiment of the invention.

The invariance of the drop volume compensation to the reflector sensor utilized is shown by reference to FIGS. 3 and 4. In FIG. 3, an example drop volume compensation pattern 300 is shown, according to an embodiment of the invention. The pattern 300 may be printed on media such as paper, or another type of media. The pattern 300 includes a reference pattern 302, and patterns 304A, 304B, 304C, . . . 304N at differing saturations within a range of saturations, which are referred to collectively as the patterns 304. The reference pattern 302 is output by the second colorant source, to which the first colorant source is to be color balanced. The patterns 304 are conversely output by the first colorant source.

The patterns 302 and 304 are of a reference color determined as the mixture of colors to which the different reflectance sensors are substantially invariant in their responses. The reference pattern 302 is at a given saturation, whereas the patterns 304 are at differing saturations within a range of saturations. For instance, in FIG. 3, the patterns 304 include eleven patterns, such as those within the range from 0% to 100% saturation at 10% increments. This is for illustrative purposes only. In other embodiments, the patterns may include more patterns, such as those within the range from 0% to 100% saturation, but at 1% increments.

One of the patterns in the set of patterns 304 produced by the first colorant source matches the reference pattern 302 produced by the second colorant source. That is, one of the patterns 304 produced by the first colorant source has the same optical density as measured by the sensor as does the reference pattern 302 produced by the second colorant source. Determining this pattern allows the second colorant source to be color balanced to the first colorant source. That is, determining the matching pattern allows the second colorant source to be calibrated relative to the first colorant source so that it color balances to the first colorant source.

That the drop volume compensation is invariant to the reflectance sensor utilized means that the same one of the patterns 304 is selected as matching the reference pattern 302, regardless of the reflectance sensor utilized. That is, each of the reflectance sensors will respond to the same one of the patterns 304 identically as it does to the reference pattern 302. FIG. 4 specifically illustrates this reflectance sensor invariance to the drop volume compensation when utilizing the determined mixture of colorants.

In FIG. 4, the example graph 400 corresponds to the responses of three different reflectance sensors to the drop volume compensation pattern 300 of FIG. 3. The x-axis 422 thus indicates and corresponds to the positions along the media on which the reference pattern 302 and the patterns 304 of FIG. 3 have been output. The y-axis 424 indicates reflectance sensor response, which may be a voltage level, or another measurement indicating sensor response. The three lines 402, 404, and 406 correspond to the responses of the three different reflectance sensors.

The portions 408, 410, and 412 of the lines 402, 404, and 406, respectively, indicate the sensors' responses to the reference pattern 302 of FIG. 3. The remaining portions of the lines 402, 404, and 406 indicate the sensors' responses to the patterns 304 of FIG. 3. As can be seen in FIG. 4, the reflectance sensors have different responses to the reference pattern 302, indicated by the different positions along the y-axis 424 of the portions 408, 410, and 412 of the lines 402, 404, and 406.

However, significantly, each of the reflectance sensors determines the same one of the patterns 304 as matching the reference pattern 302. The portion 408 of the line 402 indicating the response to the reference pattern 302 is equal to the line 402 at the position 420 along the x-axis 422 indicating the response to the pattern 304C of the patterns 304, as indicated by the dotted line 414. Likewise, the portion 410 of the line 404 is equal to the line 404 at the position 420 along the x-axis 422, as indicated by the dotted line 416, and the portion 412 of the line 406 is equal to the line 406 at the position 420 along the x-axis 422, as indicated by the dotted line 418.

This means that regardless of the reflectance sensor utilized to perform the drop volume compensation, the same pattern 304C of the patterns 304 will be selected as matching the reference pattern 302. In other words, the drop volume compensation is invariant to, or independent of, the reflectance sensor utilized to perform the compensation. This is because the reference pattern 302 and the patterns 304 are of varying saturations of the mixture of colors, or reference color, earlier determined to yield substantially the same response from each of the reflectance sensors.

Determining Mixture of Colorants

Figure 5:
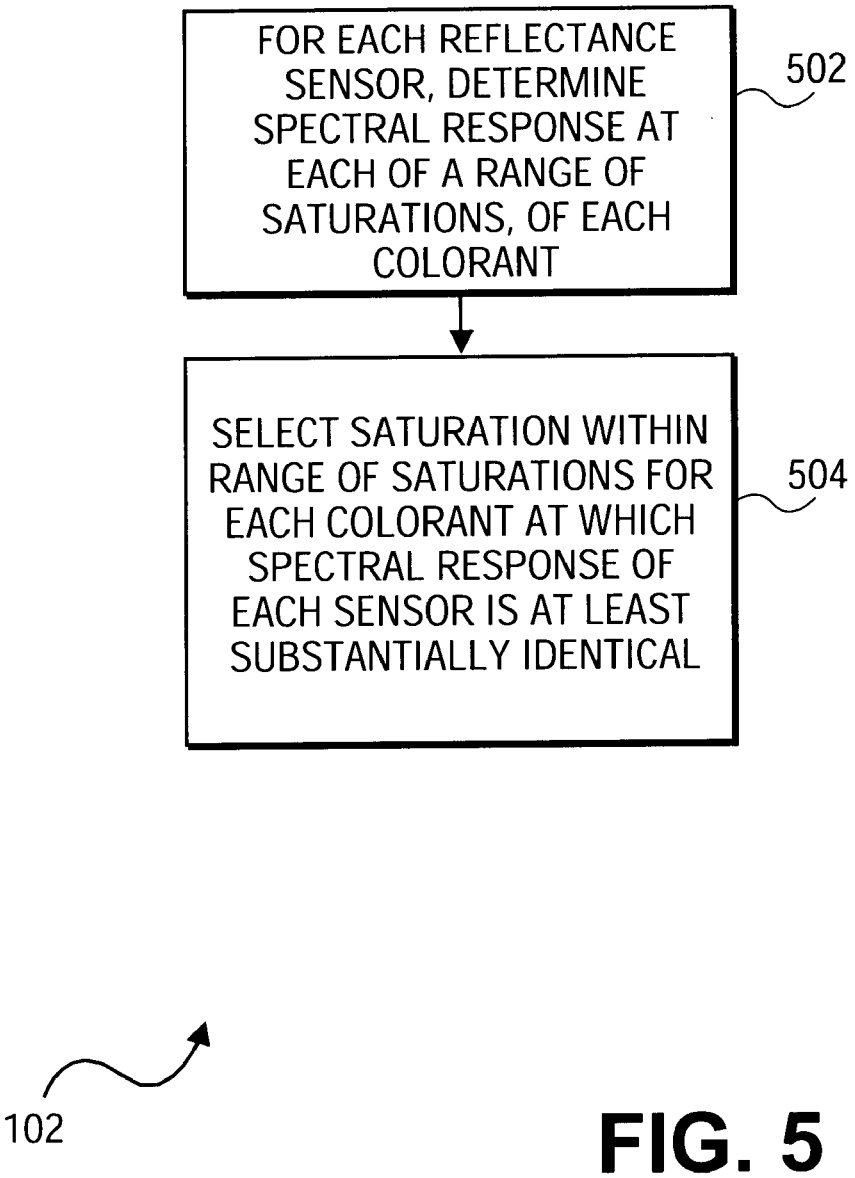
FIG. 5 is a flowchart of a method for determining a mixture of colorants for performing drop volume compensation invariant to the reflectance sensor utilized and usable with the method of FIG. 1, according to an embodiment of the invention.

FIG. 5 shows a method 102 indicating how one embodiment of the invention determines the mixture of colorants, or the reference color, to which the responses of the reflectance sensors are invariant. The method 102 of the embodiment of FIG. 5 in particular illustrates in detail how the mixture of colorants determined in 102 of the method 100 of FIG. 1 can be determined. First, for each reflectance sensor, the spectral response at each of a range of saturations, of each colorant, is determined (502). In one particular case, for the colorants cyan, magenta, and yellow, only the colorants magenta and yellow affect the spectral responses of the reflectance sensors, when a blue LED is utilized in the sensor. Therefore, the spectral response at each of a range of saturations of the magenta colorant is determined for each of the range of saturations of the yellow colorant.

In this particular case, each of the spectral responses can be determined as:

$$R = \sum_{\lambda=low}^{\lambda=high} RS_k\left[(P(\lambda) - M(\lambda))(S_M) + M(\lambda)\right]\left[(P(\lambda) - Y(\lambda))(S_Y) + Y(\lambda)\right]. \quad (1)$$

In equation (1), R is the spectral response of the reflectance sensor k, at the magenta colorant saturation $S_M$ and at the yellow colorant saturation $S_Y$. $RS_k$ is the true spectral response of the reflectance sensor k by itself. $P(\lambda)$ is the true spectral response of the paper, or other media, without any colorant being output thereon. $M(\lambda)$ is the true spectral response of the magenta colorant at 100% saturation, whereas $Y(\lambda)$ is the true spectral response of the yellow colorant at 100% saturation.

The summation occurs over the wavelength $\lambda$ within a range from low to high. This range can be the range that encompasses the ranges of all the reflectance sensors k=0 . . . N. That is, this range can be the intersection of each of the ranges of the reflectance sensors. The true spectral responses of the reflectance sensor k, the paper or other media by itself $P(\lambda)$, the magenta colorant at 100% saturation $M(\lambda)$, and the yellow colorant at 100% saturation $Y(\lambda)$ can be determined by using a spectroradiometer, photometer, or other specialized tool that can be pre-calibrated to determine these responses with negligible error.

Figure 6:
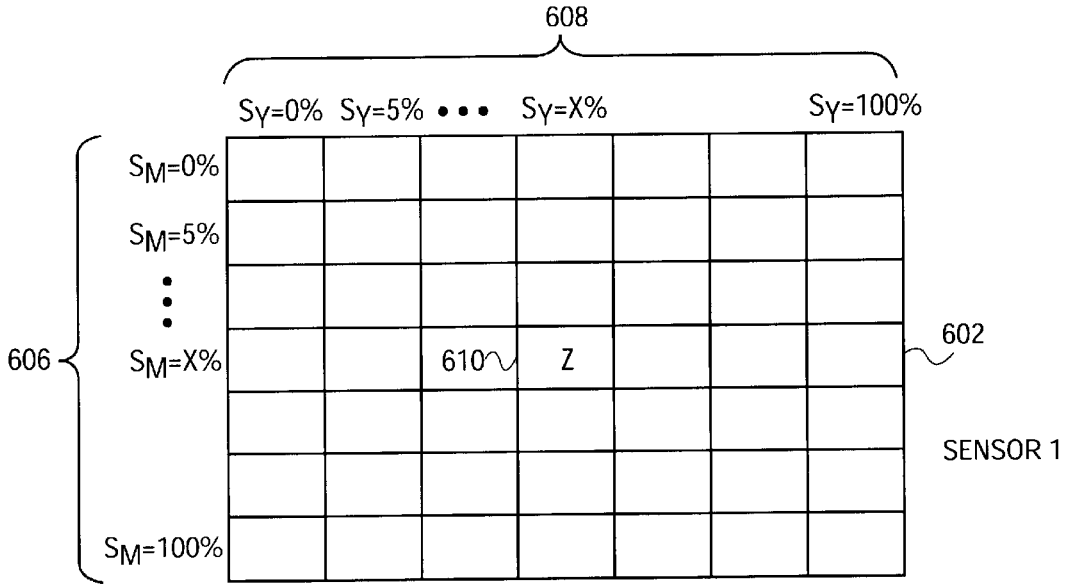
FIG. 6 is a diagram of two example tables indicating the spectral responses of two sensors to colors made up of varying saturations of magenta and yellow, in an embodiment of the invention.
Figure 6:
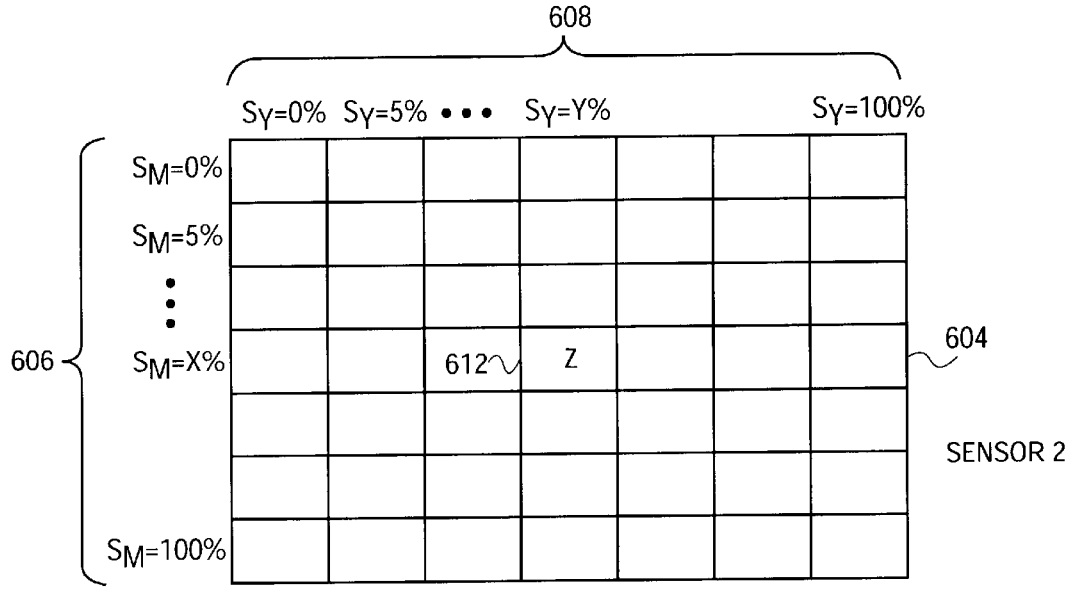

Thus, the spectral responses R that are determined for each reflectance sensor k at each unique combination of magenta colorant saturation $S_M$ and yellow colorant saturation $S_Y$ can be organized within a matrix table for each reflectance sensor k. An example of a pair of matrix tables for two reflectance sensors is shown in FIG. 6. The matrix table 602 for the first sensor and the matrix table 604 for the second sensor each have a spectral response for each unique combination of $S_M$ and $S_Y$ between the saturations 0% and 100%. Thus, each of the tables 602 and 604 has a number of rows 606 corresponding to the magenta color saturation $S_M$ between 0 and 100%, in 5% increments, and a number of columns 608 corresponding to the yellow color saturation $S_Y$ between 0 and 100%, in 5% increments.

The intersection of a given row and a given column in the table 602 thus yields the spectral response of the first reflectance sensor for the colorant mixture, or reference color, specified by the saturation of the magenta colorant at that row and the saturation of the yellow colorant at that column. Similarly, the intersection of a given row and a given column in the table 604 yields the spectral response of the second reflectance sensor for the colorant mixture, or reference color, specified by the saturation of the magenta colorant at that row and the saturation of the yellow colorant at that column. In both the matrix tables 602 and 604, the saturation of the cyan colorant is held at 0%.

Therefore, more generally, there is a matrix table for each reflectance sensor. The matrix table has a number of dimensions corresponding to the number of colorants whose saturations are being varied. The tables of 602 and 604 are two-dimensional, for instance, because only the saturations of the two colorants magenta and yellow are being varied. If the colorant cyan also has its saturation varied, then the tables would be three-dimensional, and the summation in equation (1) would also include the additional term $$[(P(\lambda)-C(\lambda))(S_C)+C(\lambda)],$$

where $C(\lambda)$ is the true spectral response of the colorant cyan at 100% saturation, at the saturation percentage $S_C$.

Referring back to FIG. 5, the method 102 next selects the saturation within the range of saturations for each colorant at which the spectral response of each sensor is at least substantially identical (504). In the particular case where only the magenta and yellow colorants affect the spectral responses of the reflectance sensors, this is the saturation of each the colorants magenta and yellow at which the spectral response of each sensor is substantially the same. The combination of the colorants at these saturations is the mixture of colorants, or the reference color, that is then used to perform drop volume compensation that is reflectance sensor invariant.

For example, in FIG. 6, the value 610 of the table 602 is the same value Z as the value 612 of the table 604. The value 610 corresponds to the response of the first reflectance sensor at the magenta and yellow colorant saturations $S_M$=X% and $S_Y$=Y%, and the value 612 corresponds to the response of the second reflectance sensor at the magenta and yellow colorant saturations $S_M$=X% and $S_Y$=Y%. Thus, at the mixture of colorants, or the reference color, represented by the colorant magenta at the saturation X% and the colorant yellow at the saturation Y%, the responses of the two reflectance sensors are the same value Z.

As can be appreciated by those of ordinary skill within the art, the reference color determined as the equal sensor response value Z for corresponding table positions within the tables 602 and 604 actually represents a family of reference colors. More specifically, this reference color can itself have its intensity varied to represent other reference colors, or other mixtures of colorants, that yield substantially the same responses from the reflectance sensors. One of these reference colors is thus selected for performing the drop volume compensation, so that the compensation is invariant to the reflectance sensor utilized.

Performing Drop Volume Compensation

Figure 7:
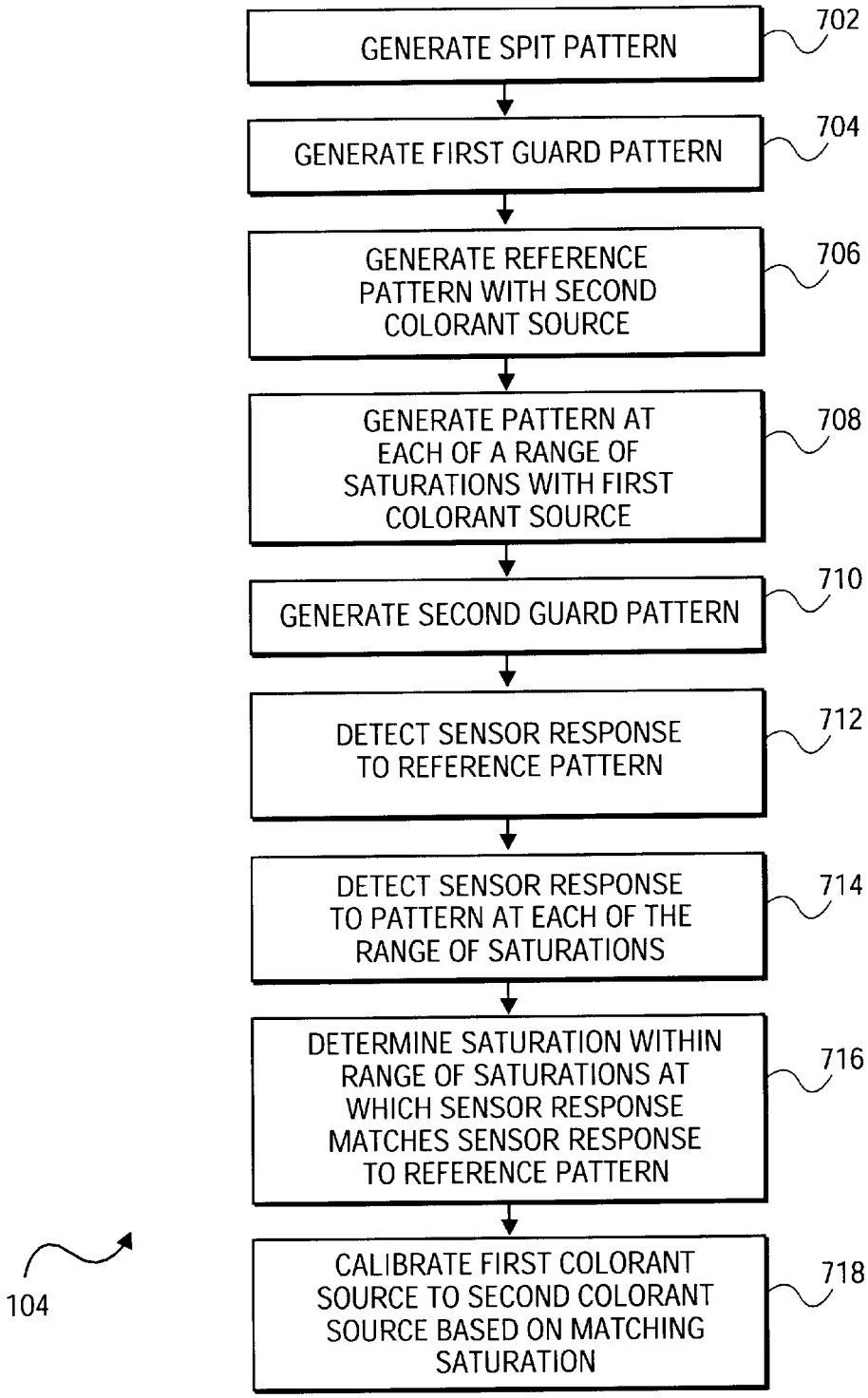
FIG. 7 is a flowchart of a method for performing drop volume compensation usable with the method of FIG. 1, according to an embodiment of the invention.

FIG. 7 shows a method 104 indicating how one embodiment of the invention performs drop volume compensation to color balance one colorant source to another colorant source. The method 104 of the embodiment of FIG. 7 in particular illustrates in detail as well as summarizes how drop volume compensation of 104 of the method 100 of FIG. 1 can be performed. First, a spit pattern is generated or otherwise output onto media, such as paper, by each of a first colorant source and a second colorant source (702). Generating the spit patterns effectively cleans these colorant sources of any extraneous or spurious colorant and primes the firing chamber of the sources with representative colorant volumes. Next, a first guard pattern is generated or otherwise output onto the media, by either or both colorant sources (704). The guard pattern shields the subsequent patterns to be generated from spurious light when the reflectance sensors are measuring their saturations.

A reference pattern is generated or otherwise output onto the media with the second colorant source (706). The reference pattern has a combination of colorants specified by the mixture of colorants, or the reference color, that was previously determined. Next, a pattern at each of a range of saturations is generated or otherwise output onto the media with the first colorant source (708). These patterns likewise are based on the combination of colorants specified by the mixture of colorants, or the reference color, that was previously determined. Next, a second guard pattern is generated or otherwise output onto the media, by either or both the colorant sources (710), to also shield the patterns that have been generated from spurious light.

Figure 8:
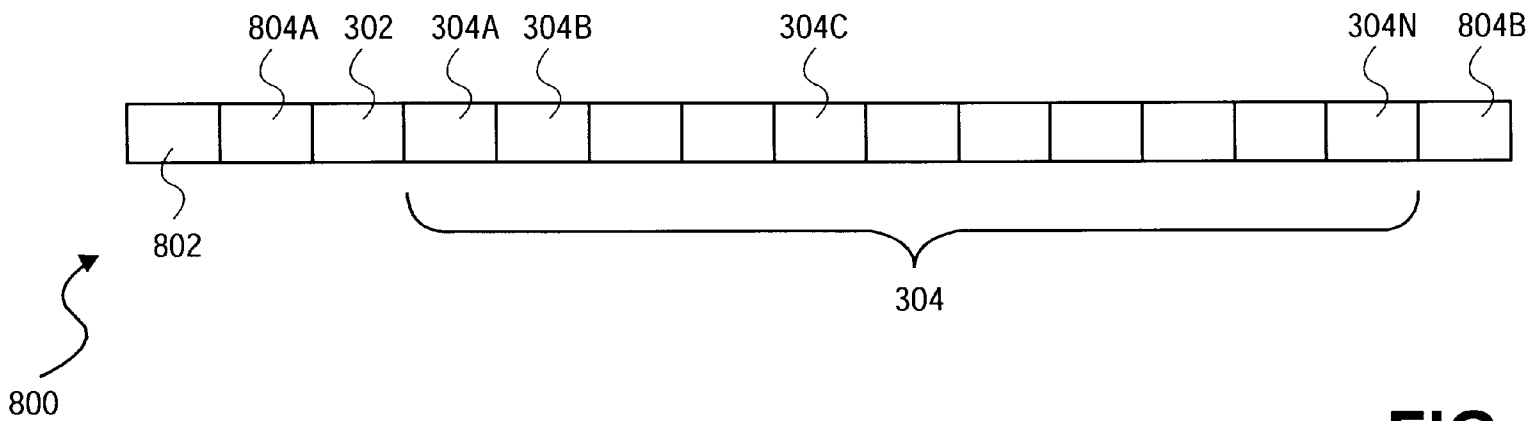
FIG. 8 is a diagram of an example of a drop volume compensation pattern that is more detailed than but consistent with the drop volume compensation pattern of FIG. 3, according to an embodiment of the invention.

FIG. 8 shows an example drop volume pattern 800 generated by performing 702, 704, 706, 708, and 710 of the method 700 of FIG. 7, according to an embodiment of the invention. The drop volume pattern 800 encompasses the drop volume pattern 300 of FIG. 3 that has been previously described. As such, the drop volume pattern 800 includes the reference pattern 302, and the patterns 304 within the range of saturations, including the patterns 304A, 304B, 304C, . . . , 304N. Also shown are the spit pattern 802, the first guard pattern 804A, and the second guard pattern 804B.

Referring back to FIG. 7, using one of the characterized reflectance sensors, the response to the reference pattern generated by the second colorant source is detected (712). Similarly, the response of this reflectance sensor is detected to the pattern generated at each of the range of saturations generated by the first colorant source (714). The pattern with the saturation within the range of saturations that has a sensor response matching the sensor response to the reference pattern is then determined (716). This effectively matches saturation output of the first colorant source to a saturation output of the second colorant source, such that the first colorant source can be calibrated to the second colorant source based on this matching saturation (718). This calibration color balances the first colorant source to the second colorant source, effecting drop volume compensation.

Example Printer (Image-Forming Device)

Figure 9:
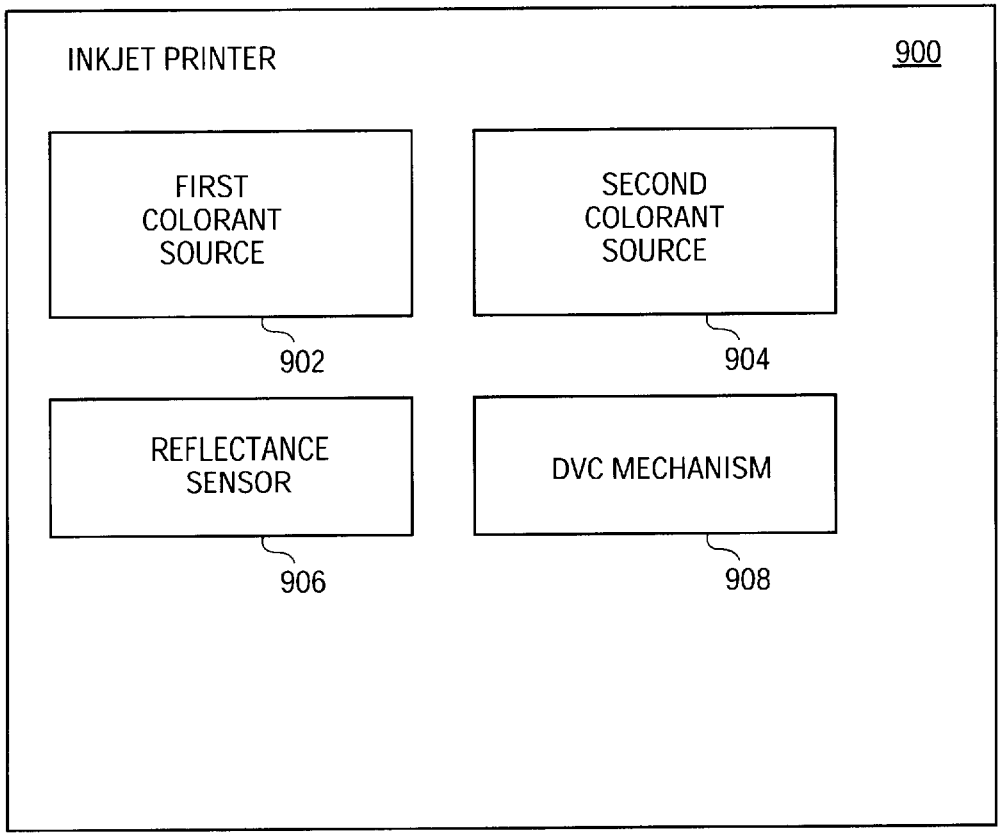
FIG. 9 is a block diagram of an example inkjet printer that can be used in conjunction with an embodiment of the invention.

FIG. 9 shows a block diagram of an example inkjet printer 900 in conjunction with which an embodiment of the invention can be implemented. The inkjet printer 900 is more generally an image-forming device that forms an image onto media, such as paper. Only those components that are used to implement an embodiment of the invention are shown in FIG. 9. As can be appreciated by those of ordinary skill within the art, the inkjet printer 900 may also and typically does include other components.

The inkjet printer 900 includes first and second colorant sources 902 and 904. Each of these colorant sources 902 and 904 may be an inkjet print cartridge, containing one or more inkjet ejectors, such as nozzles. Each colorant source 902 and 904 includes a number of different colorants, such as different versions of the colorants cyan, magenta, yellow, and black. For instance, the first colorant source 902 may include light-dye versions of these colorants, whereas the second colorant source 904 may include standard-dye versions. The colorants may more particularly be color inks in one embodiment.

The inkjet printer 900 also includes a reflectance sensor 906 and a drop volume compensation mechanism 908. The mechanism 908 can be firmware, for instance, that includes a computer program to perform drop volume compensation to color balance the first colorant source 902 to the second colorant source 904, using a mixture of the colorants and the reflectance sensor 906. The reflectance sensor 906 may include a light-emitting diode (LED), such as a blue LED, or another type of illuminate. As has been described, the mixture of colorants on which basis drop volume compensation is performed is determined so that the compensation is invariant to the spectral emission profile, such as the light output peak wavelength, of the reflectance sensor 906.

Conclusion

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, whereas the invention is partially described in relation to colorants that are ink, colorant sources that are inkjet print cartridges, and image-forming devices that are inkjet printers, it is more broadly applicable of any type of colorants, colorant sources, and image-forming devices. Therefore, it is manifestly intended that only the claims and equivalents thereof limit embodiments of this invention.

I claim:

1. A method comprising:

printing a pattern of a predetermined mixture of a plurality of colorants that results in at least a substantially identical response from each of a plurality of reflectance sensors having different illuminate spectral emission profiles; and, performing drop volume compensation to color balance a first colorant source to a second colorant source utilizing the predetermined mixture of the plurality of colorants and one of the plurality of reflectance sensors, such that the drop volume compensation is at least substantially invariant to an illuminate of the one of the plurality of reflectance sensors utilized.

2. The method of claim 1, wherein the mixture of the plurality of colorants is predetermined by performing a method comprising:

for each of the plurality of reflectance sensors, determining a spectral response at each of a range of saturations of each of the plurality of colorants; and, selecting a saturation within the range of saturations for each of the plurality of colorants at which the spectral response for each of the plurality of reflectance sensors is at least substantially identical.

3. The method of claim 1, wherein the mixture of the plurality of colorants is predetermined by performing a method comprising:

for each of the plurality of reflectance sensors, determining a spectral response at each of a range of saturations of a first colorant of the plurality of colorants for each of the range of saturations of a second colorant of the plurality of colorants; and, selecting a first saturation within the range of saturations for the first colorant and a second saturation for the second colorant at which the spectral response for each of the plurality of reflectance sensors is at least substantially identical.

4. The method of claim 1, wherein performing the drop volume compensation comprises:

generating a reference pattern on a media of the mixture of the plurality of colorants at a selected saturation with the second colorant source, the reference pattern part of the pattern printed;

generating a pattern on the media of the mixture of the plurality of colorants at each of a range of saturations with the first colorant source, the pattern part of the pattern printed;

detecting a response of the one of the plurality of reflectance sensors to the reference pattern;

detecting a response of the one of the plurality of reflectance sensors to the pattern at each of the range of saturations;

determining a matching saturation within the range of saturations at which the response of the one of the plurality of reflectance sensors to the pattern is at least substantially identical to the response of the one of the plurality of reflectance sensors to the reference pattern; and, calibrating the first colorant source to the second colorant source based on the matching saturation.

5. The method of claim 4, wherein performing the drop volume compensation further comprises:

generating a spit pattern to clean the first colorant source and the second colorant source, the spit pattern part of the pattern printed; and, generating guard patterns to shield the reference pattern and the pattern at each of the range of saturations from spurious light, the guard patterns part of the pattern printed.

6. The method of claim 1, wherein the plurality of colorants comprises a plurality of inks and each of the first colorant source and the second colorant source comprises one or more inkjet ejectors.

7. The method of claim 1, wherein the plurality of colorants comprises at least one cyan colorant, at least one magenta colorant, and at least one yellow colorant.

8. A method comprising:

for each of a plurality of reflectance sensors, determining a spectral response at each of a range of saturations of each of a plurality of colorants; and, selecting a saturation within the range of saturations for each of the plurality of colorants at which the spectral response for each of the plurality of reflectance sensors is at least substantially identical to determine a reference color, such that drop volume compensation can subsequently be performed to color balance a first colorant source to a second colorant source utilizing the reference color and one of the plurality of reflectance sensors.

9. The method of claim 8, wherein, for each of the plurality of reflectance sensors, determining the spectral response at each of the range of saturations of each of the plurality of colorants comprises determining the spectral response at each of the range of saturations of a first colorant of the plurality of colorants for each of the range of saturations of a second colorant of the plurality of colorants.

10. The method of claim 9, wherein selecting the saturation within the range of saturations for each of the plurality of colorants at which the total response for each of the plurality of reflectance sensors is at least substantially identical comprises selecting a first saturation within the range of saturations for the first colorant and a second saturation for the second colorant at which the spectral response for each of the plurality of reflectance sensors is at least substantially identical.

11. The method of claim 8, wherein the drop volume compensation is subsequently performed by performing a method comprising:

generating a reference pattern on a media of the reference color at a selected saturation with the second colorant source;

generating a pattern on the media of the reference color at each of a range of saturations with the first colorant source;

detecting a response of the one of the plurality of reflectance sensors to the reference pattern;

detecting a response of the one of the plurality of reflectance sensors to the pattern at each of the range of saturations;

determining a matching saturation within the range of saturations at which the response of the one of the plurality of reflectance sensors to the pattern is at least substantially identical to the response of the one of the plurality of reflectance sensors to the reference pattern; and, calibrating the first colorant source to the second colorant source based on the matching saturation.

12. The method of claim 11, wherein the method for performing the drop volume compensation further comprises:

generating a spit pattern to clean the first colorant source and the second colorant source; and, generating guard patterns to shield the reference pattern and the pattern at each of the range of saturations from spurious light.

13. The method of claim 8, wherein the plurality of colorants comprises a plurality of inks and each of the first colorant source and the second colorant source comprises one or more inkjet ejectors.

14. The method of claim 8, wherein the plurality of colorants comprises at least one cyan colorant, at least one magenta colorant, and at least one yellow colorant.

15. A computer-readable medium having a computer program stored thereon comprising:

first means for printing a pattern of a predetermined mixture of a plurality of colorants that results in at least a substantially identical response from each of a plurality of reflectance sensors having different illuminate spectral emission profiles; and, second means for performing drop volume compensation to color balance a first colorant source to a second colorant source utilizing the pattern of the predetermined mixture of the plurality of colorants and one of the plurality of reflectance sensors, such that the drop volume compensation is at least substantially invariant to an illuminate of the one of the plurality of reflectance sensors utilized.

16. The medium of claim 15, wherein the plurality of colorants comprises a plurality of inks and each of the first colorant source and the second colorant source comprises one or more inkjet ejectors.

17. The medium of claim 15, wherein the plurality of colorants comprises at least one cyan colorant, one magenta colorant, and one yellow colorant.

18. The medium of claim 15, wherein the medium comprises firmware.

19. An image-forming device comprising:

a reflectance sensor;

a first colorant source of a plurality of colorants;

a second colorant source of the plurality of colorants; and, a mechanism to perform drop volume compensation to color balance the first colorant source to the second colorant source using a mixture of the plurality of colorants and the reflectance sensor, the mixture of the plurality of colorants pre-selected so that the drop volume compensation is at least substantially invariant to an illuminate of the reflectance sensor.

20. The device of claim 19, wherein the reflectance sensor is selected from a plurality of reflectance sensors having different illuminate spectral emission profiles.

21. The device of claim 19, wherein the reflectance sensor is selected from a plurality of reflectance sensors having different light output peak wavelengths.

22. The device of claim 19, wherein the illuminate of the reflectance sensor comprises a light-emitting diode (LED).

23. The device of claim 19, wherein the illuminate of the reflectance sensor comprises a blue light-emitting diode (LED).

24. The device of claim 19, wherein the plurality of colorants comprises a plurality of inks, each of the first colorant source and the second colorant source comprises one or more inkjet ejectors, and the image-forming device comprises an inkjet printer.

25. The device of claim 19, wherein the plurality of colorants comprises at least one cyan colorant, at least one magenta colorant, and at least one yellow colorant.

26. The device of claim 25, wherein the at least one cyan colorant comprises a light-dye cyan colorant and a standard-dye cyan colorant, the at least one magenta colorant comprises a light-dye magenta colorant and a standard-dye magenta colorant, and the at least one yellow colorant comprises a light-dye yellow colorant and a standard-dye yellow colorant.

27. The device of claim 19, wherein the mechanism comprises firmware.

28. The device of claim 19, wherein the mixture of the plurality of colorants is pre-selected according to a method comprising:

for each of a plurality of reflectance sensors having different spectral emission profiles and from which the reflectance sensor of the device is selected, determining a spectral response at each of a range of saturations of each of the plurality of colorants; and, selecting a saturation within the range of saturations for each of the plurality of colorants at which the spectral response for each of the plurality of reflectance sensors is at least substantially identical.

29. The device of claim 19, wherein the mixture of the plurality of colorants is pre-selected according to a method comprising:

for each of a plurality of reflectance sensors having different spectral emission profiles and from which the reflectance sensor of the device is selected, determining a spectral response at each of a range of saturations of a first colorant of the plurality of colorants for each of the range of saturations of a second colorant of the plurality of colorants; and, selecting a first saturation within the range of saturations for the first colorant and a second saturation for the second colorant at which the spectral response for each of the plurality of reflectance sensors is at least substantially identical.

30. The device of claim 19, wherein the image-forming device comprises a printer.

31. A method for printing a drop volume compensation pattern on a medium, comprising:

printing a reference pattern of a reference color at a selected saturation generated by a second colorant source, the reference color pre-selected so that drop volume compensation to color balance a first colorant source to the second colorant source is at least substantially invariant to an illuminate of each of a plurality of reflectance sensors having different illuminate spectral emission profiles; and, printing a pattern of the reference color at each of a range of saturations generated by the first colorant source, the drop volume compensation performable by determining a matching saturation within the range of saturations at which the response of any of the plurality of reflectance sensors to the pattern is at least substantially identical to a response thereof to the reference pattern.

32. The method of claim 31, further comprising:

printing a spit pattern to clean the first colorant source and the second colorant source; and, printing guard patterns to shield the reference pattern and the pattern of the reference color at each of the range of saturations from spurious light.

33. The method of claim 31, wherein the plurality of colorants comprises a plurality of inks, each of the first colorant source and the second colorant source comprises one or more inkjet ejectors, and the image-forming device comprises an inkjet printer.

34. The method of claim 31, wherein the plurality of colorants comprises at least one cyan colorant, at least one magenta colorant, and at least one yellow colorant.

* * * * *